US006796033B2

(12) United States Patent
Owoc

(10) Patent No.: US 6,796,033 B2
(45) Date of Patent: Sep. 28, 2004

(54) UTILITY KNIFE

(76) Inventor: Greg J. Owoc, 106 Galphin Dr., Greenville, SC (US) 29609

( * ) Notice: Subject to any disclaimer, the term of this patent is extended or adjusted under 35 U.S.C. 154(b) by 144 days.

(21) Appl. No.: 10/073,533

(22) Filed: Feb. 11, 2002

(65) Prior Publication Data

US 2003/0150117 A1 Aug. 14, 2003

(51) Int. Cl.[7] ..... B26B 3/06
(52) U.S. Cl. ..... 30/162; 30/335
(58) Field of Search ..... 30/162, 335, 2

(56) References Cited

U.S. PATENT DOCUMENTS 158,830 A * 1/1875 Buterworth ..... 30/320
4,139,939 A * 2/1979 Crooks ..... 30/2
4,242,795 A 1/1981 Rollband et al.
5,906,050 A 5/1999 Gilbert
6,321,454 B1 11/2001 Wass

* cited by examiner

*Primary Examiner*—Douglas D. Watts
(74) *Attorney, Agent, or Firm*—Robert R. Reed

(57) ABSTRACT

The utility knife of the present invention has a cutting blade that is extended to any desired length from the knife handle by providing a blade assembly and a blade deployment device supported in an internal cavity within a knife handle. In particular, the blade can be extended any desired distance from the front face of the handle between the full deployed position and the fully retracted position. No additional structure or locking devices are generally required to retain and hold the blade in a predetermined position from a handle opening when it has been deployed by the blade deployment device. Optional aspects of the invention include a blade position arm and indices, a locking collar and an elongated handle that may be made to articulate.

19 Claims, 8 Drawing Sheets

A
10b
10a
14
22
20
24
50
43
30
16
45

10
14a
47
12
46
L
48
B
44
42
52
54
56
C
32
15

22a

A
110
114
110b
34
11
12
B
15
30
C 20
22
24

50
56

50a
52
54
32

118
16
110a

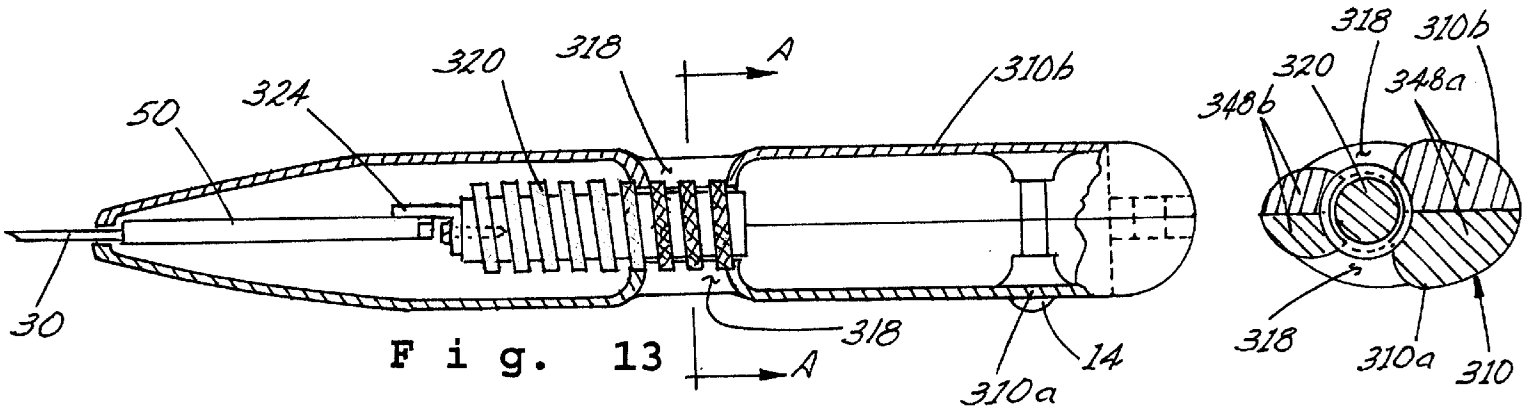
Fig. 13A
Fig. 13
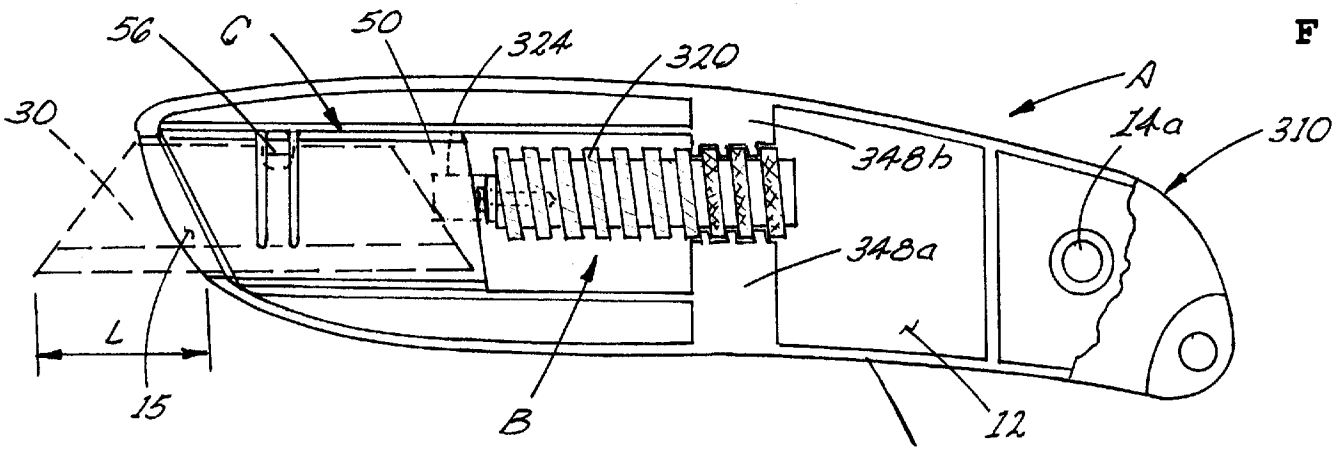
Fig. 12

UTILITY KNIFE

BACKGROUND OF THE INVENTION

This invention is directed to a utility knife and, in particular, to a hand held utility knife with a cutting blade that can be stored in a handle and extended from the handle to any desirable length from the handle to a fully extended position.

The utility knife is commonly used for various cutting needs around the house and by a craftsman to serve the cutting needs associated with a job or profession. For example, wrapping and shipping materials and goods in containers, as well as opening containers, frequently require the use of a utility knife to make the job much easier to accomplish. The length of the cutting blade extending from the handle is critical for not cutting to a depth that would damage goods beyond the material that needs to be cut. The goods that should not be damaged can be at any length relative to the end of the knife handle from which the blade extends. The use of a utility knife is further improved by the general shape of the handle. The shape of the handle relative to the cutting blade provides a gripping surface for better alignment of the blade with respect to the material being cut.

A typical utility knifes of the general type being described herein are disclosed in U.S. Pat. Nos. 4,242,795; 5,960,050; and 6,321,454 B1. The knife handle of '795 discloses a handle that is depressed for manipulating and latching a blade relative to a handle opening. A thumb button allows a latching tab of a resilient finger extending from a blade carrier to engage a notch in the handle depression to fix the extension of the blade from a front end of the handle. A series of four notches is provided to allow four positions of the blade relative to the handle opening. The disclosure of '050 provides a utility knife having a curvilinear slot in the side of the handle that guides a button to advance the blade in a rectilinear track to extend from the handle. The button is part of a mechanism having a spigot on an end that fits into a hole in the blade for extending the blade from the front end of the handle. The mechanism is guided by internal ribs and a detent in the mechanism engages detent recesses in the handle for positioning the blade. The detent recesses are to provide for a "snap-off" type blade so the recesses correspond to the score lines in the blade. If a trapezoidal blade is used the blade must have one or more holes. Once again the number of positions that the blade extends from the housing is limited. The utility knife of '545 discloses guide cheeks of the handle housing to ensure the knife cuts in a uniform angular relationship relative to an adjacent planar surface to insure that the blade cuts material at a uniform and preselected angle. This utility knife has an elongated and curvilinear handle so that gripping the handle at different locations adjusts the angle of the hand relative to the blade. The utility knife of '545 also provides a blade at both ends for providing alternate angular relationships of the blade relative to the hand. The blades of this patent are not adjustable in the length from the handles.

The need remains to have a utility knife that can be adjusted so that the blade extends from the handle at any desired cutting length from the front end of the handle. This cutting length adjustment is necessary to cut only the material to be separated and not damage any of the material not being cut by the blade. A further need exists to be able to adjust the relationship between the hand held body portion of the utility knife and the blade retainer portion for better gripping to control the depth of a cut.

Accordingly, an object of the present invention is to provide a utility knife where the length of the blade extending from the front end of the housing can be easily adjusted by hand to any value between fully extended and fully retracted.

Another object of the present invention is to provide alternate structural means for extending and retracting the cutting blade of the utility knife to provide a variable and stable cutting length for the blade extension from the blade opening of the handle.

Still another object of the present invention is to provide an elongated handle body that is modified to change the orientation between the cutting blade assembly and the gripping surface portion of the handle and to provide blade storage in the handle.

SUMMARY OF THE INVENTION

The above objectives are accomplished according to the present invention by providing a blade assembly and a blade deployment device supported in an internal cavity within a knife handle. In particular, the blade can be extended any desired distance from the front face of the handle between the full deployed position and the fully retracted position. No additional structure or locking devices are generally required to retain and hold the blade in a predetermined position from a handle opening when it has been deployed by the blade deployment device. An alternate locking collar can be provided to prevent accidental changes in the blade deployment length while the material is being cut.

A hand held utility knife or RollaBlade of this invention comprises a knife handle having first and second handle halves, an internal cavity and a blade opening. The handle halves are held together by a connector. A blade assembly is provided having a blade retainer and a cutting blade. The blade retainer is slidably mounted within said internal cavity of said knife handle to support the cutting blade to extend from the blade opening. A blade deployment device is mounted in the internal cavity of the handle to be accessible from the exterior of the handle for moving the blade retainer to extend the blade from the blade opening any desired distance from a fully extended position to fully retracted. The cutting blade is held and safely used at any desired intermediate position between fully extended to fully retracted.

In another aspect of the present invention, a utility knife or RollaBlade system is provided for use with hand held utility knifes. The utility knife system comprises a knife system handle having an internal cavity with first and second support ribs and a blade opening at a front end. A cutting blade is carried by a blade retainer within said internal cavity. The blade retainer is slidably supported and guided by the first support ribs. A deployment rod is appropriately attached to the blade retainer for displacing the blade retainer so that the cutting blade extends from the blade opening. A deployment wheel associated with the deployment rod is rotated to displace the deployment rod. The deployment rod and wheel are supported by the second support ribs and the cutting blade is extended and held relative to the blade opening at any desired distance from fully extended to fully retracted.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 12 is a side elevation view of a fourth embodiment of the utility knife of the present invention showing the cutting blade extended a desired length from the handle of the utility knife and a blade deployment rod accessed from at least one lateral side of the handle for deploying the cutting blade;

FIG. 13 is an internal side elevation view of the utility knife of FIG. 12 showing the support for the deployment rod provided by the support ribs of the handle;

FIG. 13A is a cross-sectional view taken along line A—A in FIG. 13;

DESCRIPTION OF A PREFERRED EMBODIMENT

Figures 1, 2, 2A, 3:
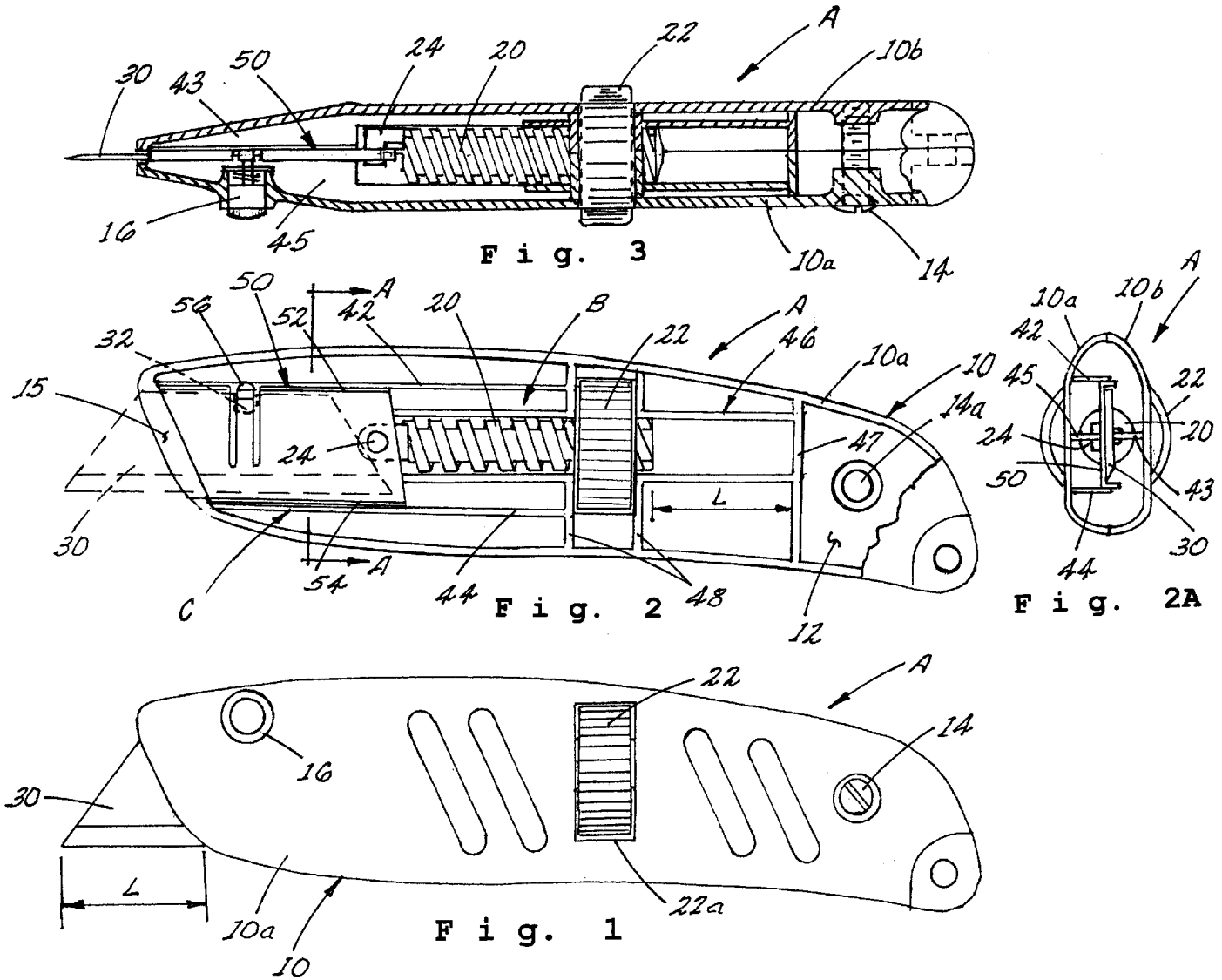
FIG. 1 is a side elevation view of the preferred embodiment of a utility knife of the present invention showing a cutting blade extended a desired length from a handle of the utility knife and a blade deployment wheel accessed from the side of the handle for deploying the cutting blade.
FIG. 2 is an internal side elevation view of the utility knife of FIG. 1.
FIG. 2A is a cross-sectional view taken along line A—A in FIG. 2.
FIG. 3 is a plan cross-sectional view of the utility knife of FIG. 1.

Referring now in more detail to the drawings, the invention will now be described in more detail. The preferred embodiment of the invention is illustrated in FIGS. 1–3. A utility knife of the present invention is referred to herein as a RollaBlade "A". A knife handle 10 is formed by mating first and second handle halves 10*a* and 10*b* respectively. The handle halves are held together by a connector 14 extending through internal ribs 14*a* of the knife handle. The knife handle includes an internal cavity 12 for storage of a cutting blade 30 to be extended from a blade opening 15 when the blade is used for cutting an object. The blade extends from fully retracted inside the internal cavity to fully extended to expose a length "L" of the cutting blade, as illustrated in FIGS. 1 and 2. The cutting blade is held by a blade retainer 50 within the handle. The blade retainer and cutting blade combination are referred to herein as the blade assembly "C". The blade assembly is slidably restrained for linear movement toward the front or toward the rear by first ribs 42 and 44 extending from the second handle half. Conventional front and rear directions for this invention are indicated by the left and right arrows respectively in FIG. 1. The rear to front or front to rear direction is referred to herein as the longitudinal direction of the utility knife. A top flange 52, a bottom flange 54 and a tab portion 56 of the blade retainer hold and support the cutting blade in position in the blade retainer to be extended from the blade opening by sliding the blade retainer between top and bottom first ribs 42 and 44. The tab portion fits into blade notch 32. An optional blade release 16 carried by first handle half 10*a* can be included to displace tab 56 and release cutting blade 30 from blade retainer 50; without the need to remove connector 14 to open the handle when replacing cutting blade 30. Blade retainer 50 is supported within the knife handle by a plurality of ribs extending from first and second handle halves 10*a* and 10*b*, as illustrated in cross-sectional view of FIG. 2A. This view is taken along line A—A in FIG. 2. Ribs 42 and 44 support the top and bottom flanges of blade retainer 30 and ribs 43 and 45 support the blade retainer and blade 30 at a mid-height. This method of supporting blade assembly C within the knife handle with support ribs generally applies to all embodiments of the invention.

The blade assembly is displaced by a blade deployment device "B" supported in the handle by a rod support 46 carried by second ribs 47 and wheel ribs 48 from handle halves 10*a* and 10*b*. For the preferred embodiment of the invention, the blade deployment device comprises a threaded deployment rod 20 and a deployment wheel 22. Deployment wheel 22 for the preferred embodiment is accessed from both lateral sides of the first and second handle halves, as illustrated in FIG. 2A. The deployment wheel has a center opening threaded to receive the threaded deployment rod, as illustrated in FIGS. 2 and 3. The deployment wheel is disposed in the knife handle between wheel ribs 48 to be free to rotate about its center axis. Deployment wheel 22 extends beyond knife handle 10 on both lateral sides to be accessible to rotate by hand. When the deployment wheel is rotated, deployment rod 20 moves linearly within the handle. A front end of the deployment rod includes a retainer connector 24 which is connected to the rear end of blade retainer 50. Therefore, when the deployment wheel is rotated by hand, cutting blade 30 is deployed in or out of blade opening 15. In a unique feature of the utility knife, rapid deployment of the cutting blade is made possible by placing the knife handle on one side on a flat surface and dragging the utility knife across the surface to rotate the deployment wheel. In addition, the deployment rod can be made having only a few threads per inch for rapid deployment of the cutting blade, or with many threads per inch for accurate deployment of the cutting blade to a precise length from the blade opening. Rotating the deployment wheel in one direction deploys the cutting blade out the is blade opening and rotating the deployment wheel the other direction retracts the cutting blade. The cutting blade is displaced and held at any position from fully deployed at length L to fully retracted in the knife handle.

Figures 4, 4A, 4B, 4C, 4D, 5:
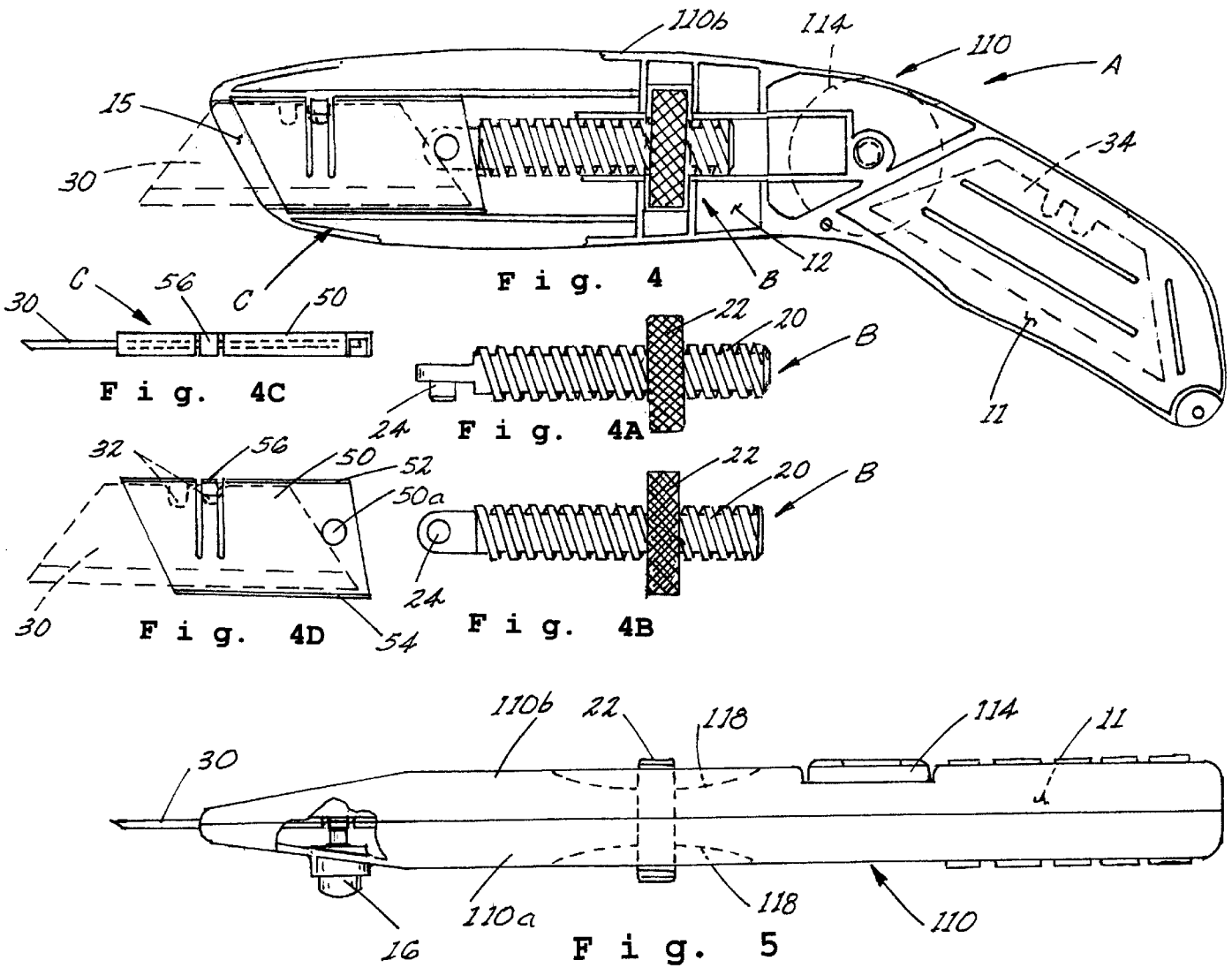
FIG. 4 is an internal side elevation view of the preferred embodiment of a utility knife of the present invention showing an aspect of the invention wherein the handle is elongated and extended at an angle to provide a pistol grip type handle having a storage volume for cutting blades.
FIGS. 4A & 4B are top and side views respectively of a blade deployment assembly of the preferred embodiment of FIGS. 2 and 4.
FIGS. 4C & 4D are top and side views respectively of a blade assembly of the preferred embodiment of FIGS. 2 and 4.
FIG. 5 is a top view of the utility knife of FIG. 4.

In another aspect of the preferred embodiment of RollaBlade A of the invention, the knife handle is modified to provide an extended knife handle 110, as illustrated in FIGS. 4 and 5. Each handle half is elongated and extends at a downward angle to the rear opposite blade opening 15, as illustrated in FIG. 4. An enlarged connector 114 is provided for connecting the first and second handle halves together to form knife handle 110. A blade cavity 11 is formed inside the knife handle for storage of spare blades 34 and to provide a pistol grip shaped handle. Blade assembly C and blade deployment device B are, generally speaking, the same as those describe above. An optional wheel depression 118 can also be provided on both lateral sides of knife handle 110 to provide improved access to deployment wheel 22. Optional blade release 16 is also shown with this aspect of RollaBlade A.

Blade deployment device B is shown in more detail in FIGS. 4A and 4B. The top view of FIG. 4A and the side elevation view of FIG. 4B illustrate the threaded deployment rod screwed into the threaded center opening of the deployment wheel. Retainer connector 24 is affixed to a front end of the deployment rod to provide a connection for attaching the blade retainer to the deployment rod.

Blade assembly C is shown in more detail in FIGS. 4C and 4D. The top view of FIG. 4C and the side elevation view of FIG. 4D illustrate cutting blade 30 held between top flange 52 and bottom flange 54 of blade retainer 50. Tab portion 56 fits into one of the cutouts 32 of the cutting blade to retain the cutting blade attached to blade retainer 50. When retainer connector 24 is placed in a retainer opening 50*a*, the cutting blade is further restrained from longitudinal movement with respect to the blade retainer.

Figures 6, 7, 7A, 8:
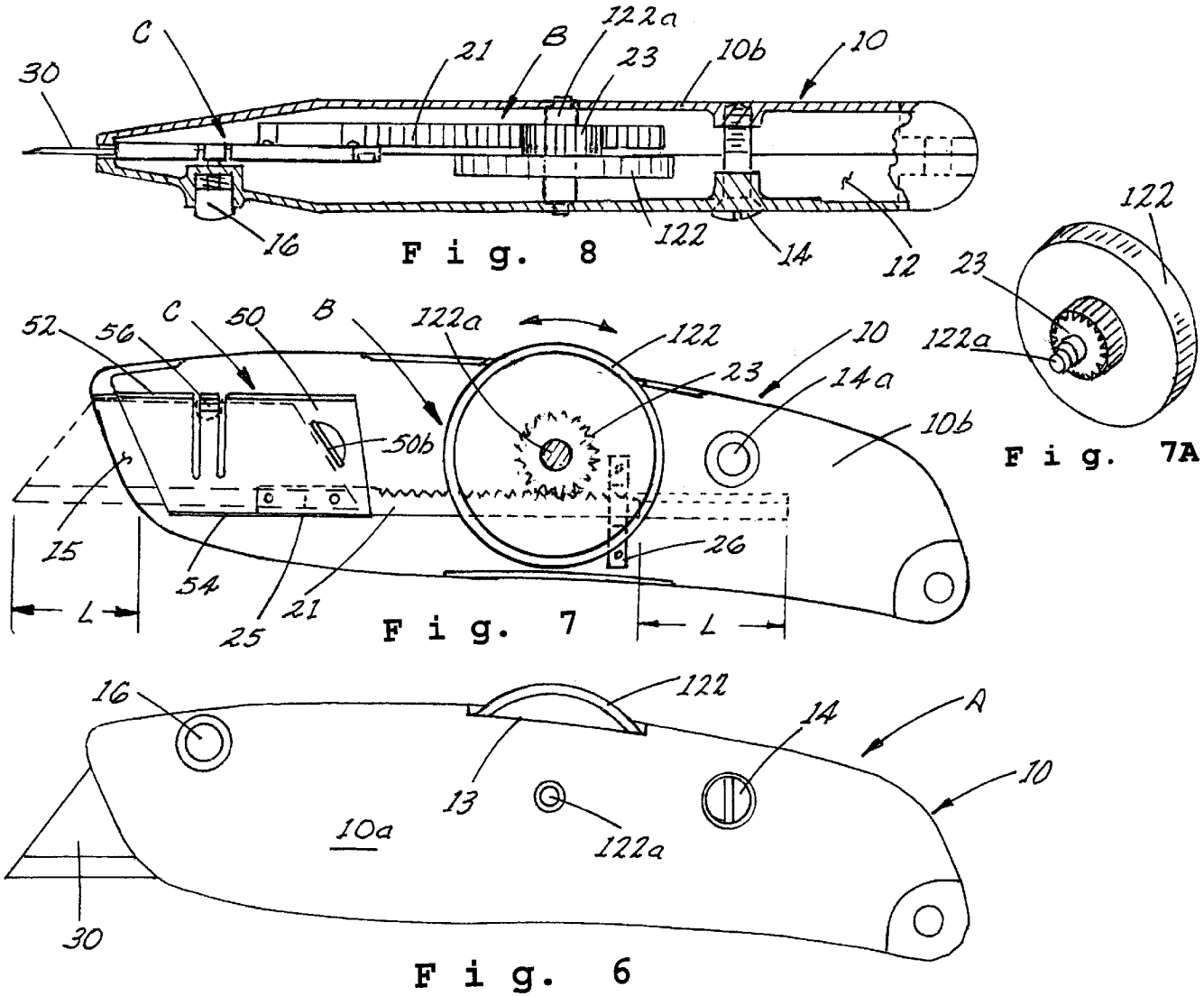
FIG. 6 is a side elevation view of a second embodiment of the utility knife of the present invention showing the cutting blade extending a desired length from the handle of the utility knife and an offset deployment wheel accessed from the top of the handle for deploying the cutting blade.
FIG. 7 is an internal side elevation view of the utility knife of FIG. 6.
FIG. 7A is a perspective view of the deployment wheel of the utility knife of FIG. 6, including a gear wheel attached to one side of the offset deployment wheel.
FIG. 8 is a plan cross-sectional view of the utility knife of FIG. 6.

A second embodiment of utility knife or RollaBlade A of this invention is illustrated in FIGS. 6–8. Blade assembly C is essentially the same as described above; including cutting blade 30 carried by blade retainer 50 supported by first ribs (not shown). One exception is the blade stop 50*b* to help restrain the cutting blade longitudinally in the blade retainer. The blade stop is necessary as the result of using rod fasteners 25 in lieu of the retainer connector previously used. The blade deployment device B of the second embodiment includes an elongated deployment rod 21 having a rectangular shaped cross-section and gear teeth 21*a* along a top side. The elongated deployment rod is affixed at a front end to blade retainer 50 using at least one rod fastener 25. A rod support 26 affixed to second handle half 10*b* guides the rear end of the elongated deployment rod so the rod can translate longitudinally inside internal cavity 12.

An offset deployment wheel 122 of the second embodiment has a gear wheel 23 attached to one lateral side which meshes with the gear teeth of the deployment rod, as illustrated in FIGS. 7 and 7A. The offset deployment wheel is supported by a wheel pivot pin 122*a* supported by the first and second handle is halves 10*a* and 10*b*. The offset deployment wheel is accessed from the exterior of the knife handle by extending through a wheel opening 13 in first handle half 10*a*. By rotating the offset deployment wheel the gear wheel rotates about the pivot pin, meshes with the gear teeth of the elongated deployment rod and moves the elongated deployment rod to displace the blade assembly with respect to the handle opening. Once again, the cutting blade is positioned and held at any desired position from fully extended at a length L to fully retracted within the knife handle.

Figure 11:
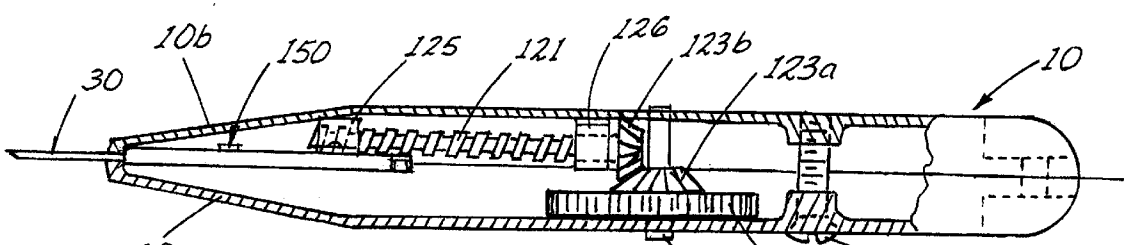
FIG. 11 is a plan cross-sectional view of the utility knife of FIG. 9.
Figure 10:
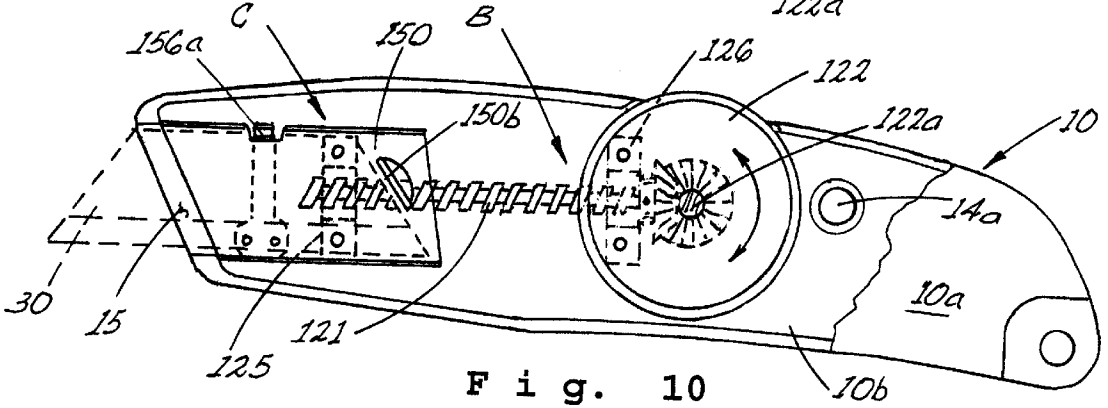
FIG. 10 is an internal side elevation view of the utility knife of FIG. 9.
Figure 9:
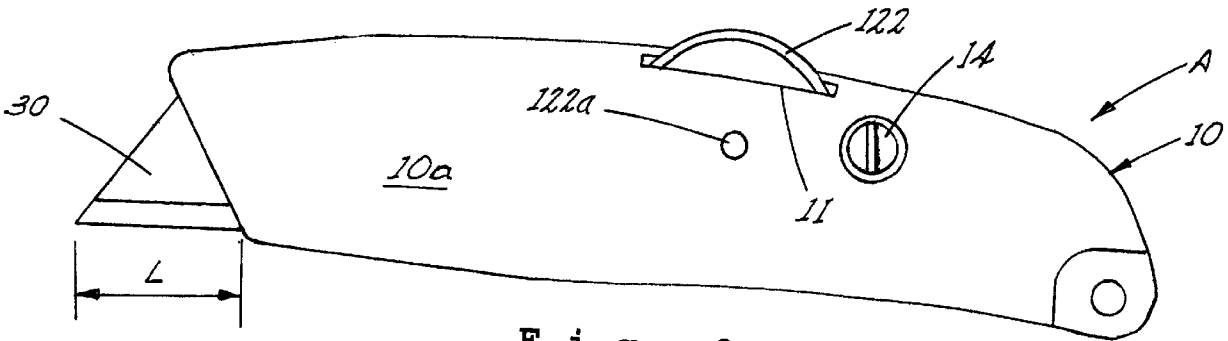
FIG. 9 is a side elevation view of a third embodiment of the utility knife of the present invention showing the cutting blade extending a desired length from the handle of the utility knife and a blade deployment wheel accessed from the top lateral side of the handle for deploying the cutting blade.

A third embodiment of the utility knife or RollaBlade A is illustrated in FIGS. 9–11. This embodiment is similar to the second embodiment except for the gear arrangement and the method of deploying the blade retainer by rotating an elongated deployment rod 121. A offset deployment wheel 122 is once again accessed through a handle opening 11 in first handle half 10*a*. A pivot pin 122*a* supports the deployment wheel from both handle halves 10*a* and 10 for rotating the deployment wheel about its center axis perpendicular to the plane of the wheel. A bevel gear having first and second parts transmits rotation of the deployment wheel to rotation of the elongated deployment rod. A first bevel gear 123*a* is affixed to the deployment wheel and a second bevel gear 123*b* is affixed to a rear end of the elongated deployment rod. A rear rod support 126 attached to second handle half 10*b* supports the elongated deployment rod so it is free to rotate. A front rod support 125 affixed to blade retainer 150 is threaded to receive the threaded surface of the elongated deployment rod. By rotating offset deployment wheel 122 the bevel gears rotate the elongated deployment rod so that blade retainer 150 and cutting blade 30 move longitudinally as a result of the threaded front rod support being affixed to the blade retainer. A blade stop 150*b* and a modified tab portion 156*a* helps support the cutting blade being carried by the blade retainer. As with the other embodiments, the cutting blade is positioned and held at any desired position from fully extended at a length L from blade opening 15 to fully retracted within the knife handle.

In a fourth embodiment of FIGS. 12, 13 and 13A of the utility knife or RollaBlade A, the blade deployment device B has been simplified. The deployment wheel of previous embodiments has been eliminated. An enlarged deployment rod 320 is supported and rotationally held by threaded support ribs 348*a* and 348*b* formed from first and second handle halves 310*a* and 310*b* within internal cavity 12 of a modified knife handle 310. A rotational connector 324 attached to the front end of the enlarged deployment rod is attached to blade retainer 50 of blade retainer assembly C. The rotational connector allows the enlarged deployment rod to apply a forward and reverse thrust to the blade retainer assembly. Rod recesses 318 within the knife handle allow the user to gain access to the enlarged deployment rod so that the rod can be rotated by hand. When rotated the enlarged deployment rod advances through the support ribs displacing blade deployment assembly longitudinally within the internal cavity 12 of knife handle 310 for deployment of cutting blade 30. The swivel connection along with retainer tab 56 hold the blade in a position to be carried by the blade retainer. The outer surface of the enlarged deployment rod can be embossed to provide assistance in turning enlarged deployment rod 320. This simplified embodiment also places the cutting blade in a position to be held at any desired position from fully extended at a length L from blade opening 15 to fully retracted within the knife handle.

Figure 16:
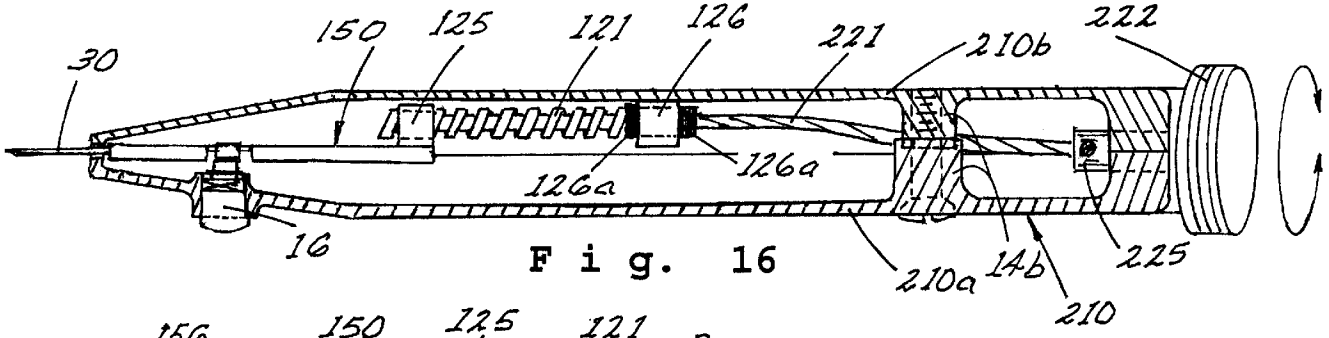
FIG. 16 is a plan cross-sectional view of the utility knife of FIG. 14.
Figure 15:
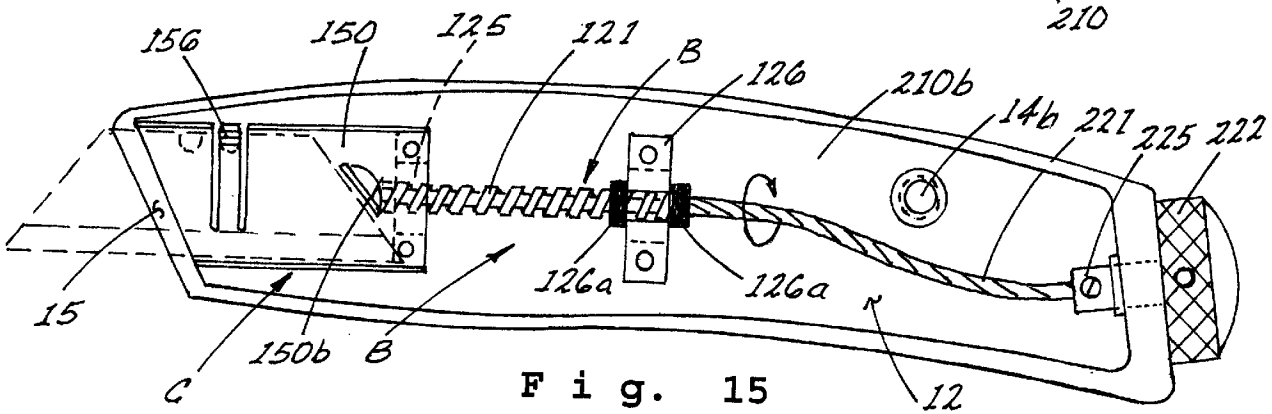
FIG. 15 is an internal side elevation view of the utility knife of FIG. 14.
Figure 14:
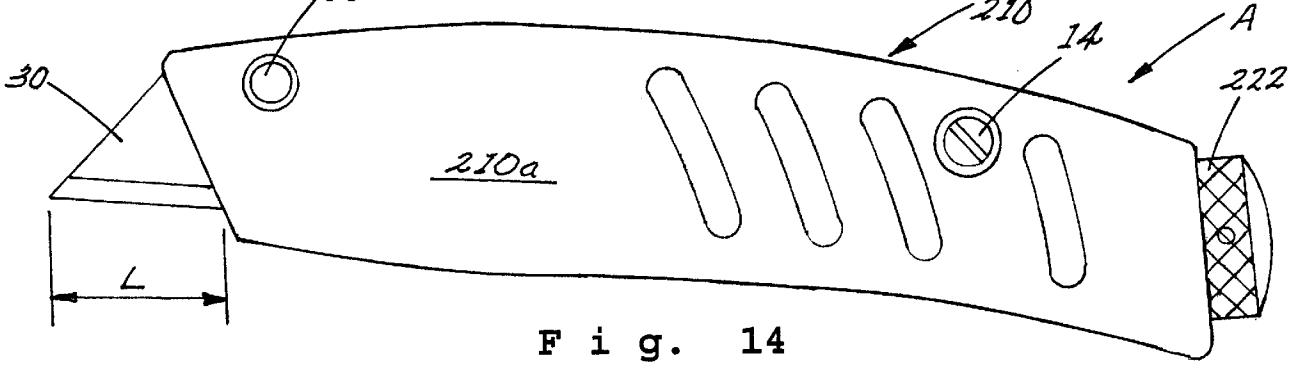
FIG. 14 is a side elevation view of a fifth embodiment of the utility knife of the present invention showing the cutting blade extending a desired length from an elongated handle of the utility knife and a blade deployment wheel accessed from rear end of the handle for deploying the cutting blade.

A fifth embodiment of the utility knife or RollaBlade A of this invention is illustrated in FIGS. 14–16. In this embodiment the blade deployment device is again modified to position an end deployment wheel 222 to the rear end of an elongated knife handle 210. The end deployment wheel and elongated knife handle make gripping the RollaBlade and access for extending or retracting the cutting blade much easier for the user. Elongated first and second handle halves 210*a* and 210*b* are again held together by connector 14 through modified internal ribs 14*b*. Elongated deployment rod 121 is again rotationally supported by rear rod support 126 affixed to second handle half 210*b*. A pair of rod support bushings 126*a* keep the elongated deployment rod from moving longitudinally within internal cavity 12 of the elongated knife handle. A torque rod 221 is connected between the rear end of the elongated deployment rod and the end deployment wheel so that turning the end deployment wheel also turns the elongated deployment rod. A wheel support 225 at the rear end of the knife handle supports the end deployment wheel and the torque rod from the elongated knife handle. A front rod support 125 affixed to blade retainer 150 is threaded to receive the threaded surface of the elongated deployment rod. When the elongated deployment rod is rotated, blade retainer assembly C moves longitudinally within the internal cavity of the elongated knife handle. Once again, blade stop 150*b* and tab portion 156 help the blade retainer carry the cutting blade. Optional blade release 16 can also be used to release the cutting blade from blade retainer 150 for inserting a new blade when necessary without separating the first and second handle halves. This elongated knife handle embodiment with a rear end deployment wheel also places the cutting blade in a position to be held at any desired position from fully extended at a length L from blade opening 15 to fully retracted within the knife handle.

Figure 18:
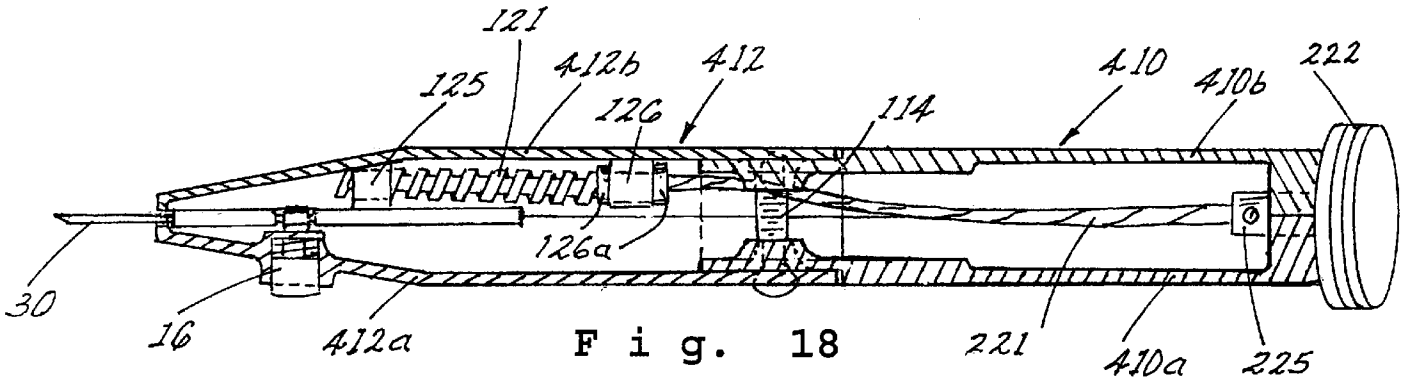
FIG. 18 is a plan cross-sectional view of the utility knife of FIG. 17.
Figure 17:
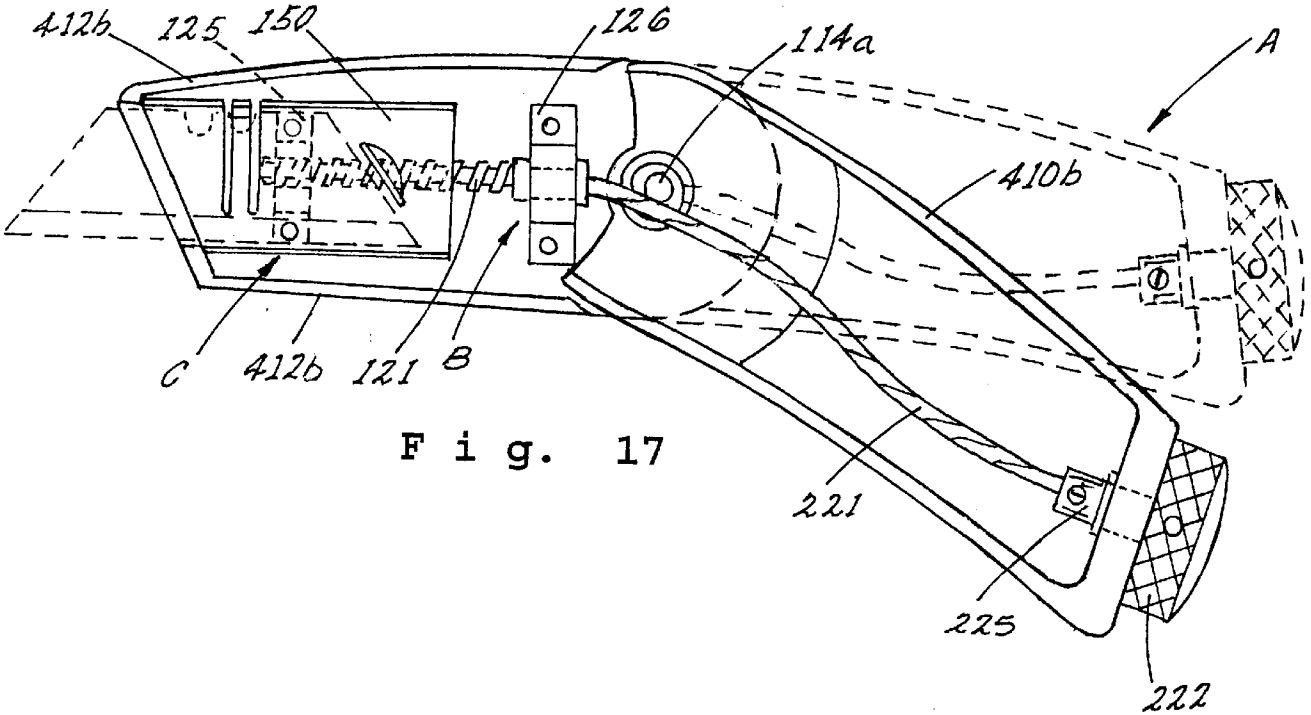
FIG. 17 is an internal side elevation view of a further aspect of the fifth embodiment of the utility knife of FIG. 14, wherein first and second handle halves are each made in two sections so the handle can be articulated in the vertical direction.

Another aspect of the fifth embodiment is illustrated in FIGS. 17 and 18. In this aspect, an articulated knife handle is provided having rear and front knife handle portions 410 and 412 respectively. Each knife handle portion is made in two sections to be joined together by a modified connector 114 extending through internal ribs 114*a* of each knife handle half. The rear knife handle portion has first and second handle halves 410*a* and 410*b* and the front knife handle portion has first and second handle halves 412*a* and 412*b*. The blade retainer assembly C and the blade deployment device B are essentially the same as described in the previous section. The articulated knife handle can be placed in a position to provide a pistol grip shaped handle by loosening the modified connector and forcing the rear portions of the articulated knife handle to move downward. This aspect of the fifth embodiment does not affect the operation of the RollaBlade as described in the description of the fifth embodiment of FIGS. 14–16.

Figure 19A:
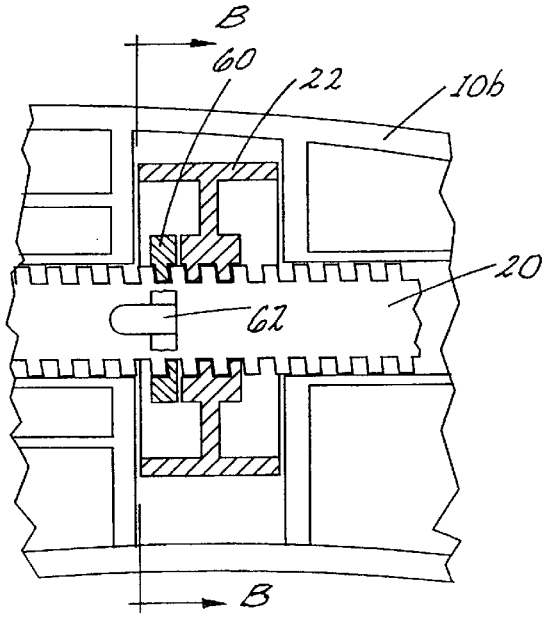
FIG. 19 A is a partial internal side elevation of the utility knife of this invention showing an alternate locking collar.
FIG. 19B is a cross-sectional view taken along line B—B in FIG. 19A.
Figure 19B:
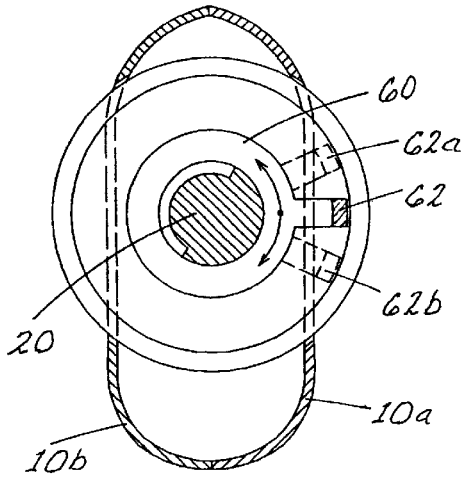

In another optional aspect of RollaBlade A, the blade deployment device includes a locking collar 60 as illustrated FIGS. 19A and 19B. The locking collar is threaded to be placed around deployment rod 20 on the front side of deployment wheel. A locking tab 62 is normally placed in a unlock position 62*a* (see FIG. 19A) to allow the deployment wheel to displace the deployment rod in the longitudinal direction when the deployment wheel is rotated. When the locking tab is rotated and placed in a lock position 62*b* the deployment wheel becomes locked against any rotation and the deployment rod cannot be moved in the longitudinal direction. This feature of the invention prevents any accidental change in the cutting blade length when material is being cut.

Figure 20:
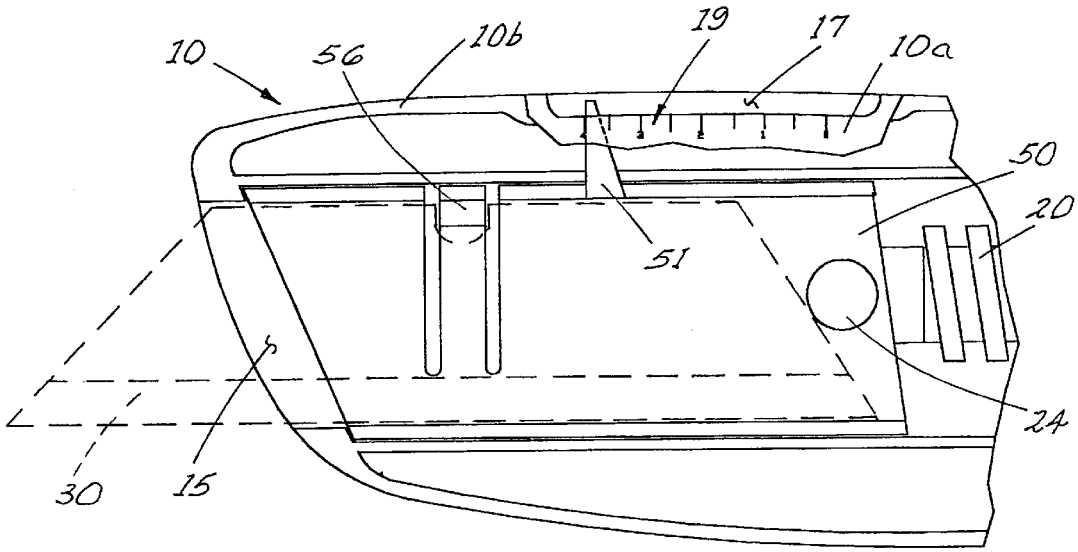
FIG. 20 in a partial internal side elevation view of the utility knife of this invention showing an alternate indexing system to identify the length of the cutting blade extension form the handle opening.

In a further optional aspect of the RollaBlade of this invention, a blade position arm 51 is included, as illustrated in FIG. 20. The position arm is affixed to blade retainer 50 and extends upward into a blade position slot 17 in first handle half 10*a*. The position arm is exposed to the user so that a relative position of cutting blade 30 to blade opening 15 of knife handle 10 can be observed. Indices 19 can be added to the first handle half adjacent the position arm to indicate this relative position. In addition, if the user knows what index number is appropriate for the material being cut, the blade can be accurately set before cutting begins.

A combination of structural features from different embodiments can be used together to form a single utility knife consistent with the claimed invention. While a preferred embodiment as well as other embodiments of of the invention has been described using specific terms, such description is for illustrative purposes only, and it is to be understood that changes and variations may be made without departing from the spirit or scope of the following claims.

What is claimed is:

1. A hand held utility knife comprising;

a knife handle having first and second handle halves, an internal cavity and a blade opening, wherein said handle halves are held together by a connector;

a blade assembly having a blade retainer and a cutting blade wherein said blade retainer is slidably mounted within said internal cavity of said knife handle to support said cutting blade to extend from said blade opening and provide easy access to said cutting blade when changing said blade;

wherein said blade retainer of said blade assembly includes: top and bottom flanges and a tab portion to position said blade within said retainer, said utility knife including a blade release formed in said first housing half that can be depressed to contact said tab portion to release said cutting blade from said retainer;

a blade deployment device mounted in said cavity of said handle, and accessible from the exterior of said handle, for moving said blade retainer to extend said cutting blade from said blade opening any desired distance from a fully extended position to fully retracted, wherein said cutting blade is held by said devolvement device and safely used at any desired intermediate position between fully extended to fully retracted.

2. The utility knife of claim 1 wherein said first and second handle halves each include ribs extending into said internal cavity for slidably supporting said blade assembly and said blade deployment device within said internal cavity of said handle.

3. The utility knife of claim 2 wherein said deployment device includes a threaded circular deployment rod with a retainer connector at a front end of said rod and a deployment wheel with a threaded center opening to receive said deployment rod, wherein said retainer connector is attached to said blade retainer so that rotating said deployment wheel translates said deployment rod and said blade retainer moving said cutting blade relative to the blade opening of said knife handle.

4. The utility knife of claim 3 wherein said blade retainer of said blade assembly includes:

a retainer opening to receive said retainer connector of said deployment rod.

5. The utility knife of claim 2 wherein said first and second handle halves are elongated and extended at a downward angle to the rear opposite said blade opening to form a blade cavity for storage of spare blades and to provide a pistol grip shaped handle.

6. The utility knife of claim 2 wherein said blade deployment device includes:

an elongated deployment rod having a rectangular shaped cross-section and gear teeth along a top side, said deployment rod affixed at a front end to said blade retainer using a rod fastener; and an offset deployment wheel including a gear wheel which meshes with said gear teeth of said deployment rod, wherein rotating said deployment wheel translates said deployment rod longitudinally and said blade retainer moving said cutting blade relative to the blade opening of said knife handle.

7. The utility knife of claim 6 wherein said blade retainer of said retainer assembly includes:

a blade stop to support said cutting blade during use.

8. The utility knife of claim 7 including a rod support affixed to said second handle half for slidably supporting said elongated deployment rod within said internal cavity so that rotating said offset deployment wheel and gear wheel translates said elongated deployment rod longitudinally to move said blade retainer and cutting blade.

9. The utility knife of claim 2 wherein said blade deployment device includes:

an elongated deployment rod having a circular shaped cross-section with threads along the length of said deployment rod, said deployment rod held at a rear end by a rear rod support affixed to said second handle half, wherein said deployment rod is free to rotate but is held from translating by said rear rod support; and an offset deployment wheel including a first bevel gear wheel which meshes with a second bevel gear wheel affixed to a rear end of said elongated deployment rod, wherein rotating said offset deployment wheel also rotates said deployment rod for moving said cutting blade relative to said blade opening of said knife handle.

10. The utility knife of claim 9 wherein said blade retainer of said retainer assembly includes:

a blade stop to support said cutting blade during use; and a front rod support affixed to said blade retainer and threaded to receive said deployment rod so that rotation of said deployment rod by rotating said offset deployment wheel translates said blade retainer longitudinally carrying said cutting blade relative to said blade opening of said knife handle.

11. The utility knife of claim 2 wherein said blade deployment device and said knife handle include: an enlarged deployment rod having a circular shaped cross-section and gear teeth along a full length;

a rotational connector rotationally attached at a front end of said enlarged deployment rod to said blade retainer, and a threaded support rib and a sidewall recess of said knife handle for supporting and accessing said enlarged deployment rod, wherein rotating said enlarged deployment rod translates said enlarged deployment rod and applies a forward and reverse thrust to said blade retainer within said internal cavity so that said blade retainer moves said cutting blade relative to said blade opening of said knife handle.

12. The utility knife of claim 11 wherein said blade retainer of said retainer assembly includes:

top and bottom flanges and a tab portion to position said cutting blade within said blade retainer; and a retainer opening to receive said swivel connector of said enlarged deployment rod.

13. The utility knife of claim 2 wherein said blade deployment device includes: an elongated deployment rod having a circular shaped cross-section with threads along a full length of said deployment rod;

a rear rod support affixed to said second handle half for holding said deployment rod at a rear end, wherein said deployment rod is free to rotate but is held from translating by said rear rod support;

a rear deployment wheel mounted to a rear portion of said knife handle; and a torque rod extending from said rear deployment rod to said elongated deployment rod affixed to a rear end of said elongated deployment rod, wherein rotating said rear deployment wheel rotates said elongated deployment rod for moving said cutting blade relative to said blade opening of said knife handle.

14. The utility knife of claim 13 wherein said blade retainer of said retainer assembly includes:

a blade stop to support said cutting blade during use; and a front rod support affixed to said blade retainer and threaded to receive said deployment rod so that rotation of said deployment rod by rotating said rear deployment wheel translates said blade retainer to carry said cutting blade in and out relative to said blade opening of said knife handle.

15. The utility knife of claim 14 wherein said knife handle includes first and second handle halves each made in two sections so the handle can be articulated in the vertical direction to provide a pistol grip shaped handle.

16. A utility knife system for use with hand held utility knifes, said utility knife system comprising:

a) a knife system handle having an internal cavity with first and second support ribs and a blade opening at a front end;

b) a cutting blade carried by a blade retainer within said internal cavity, said blade retainer slidably supported and guided by said first support ribs;

c) a deployment rod appropriately attached to said blade retainer for displacing said blade retainer so that said cutting blade extends from said blade opening; and d) a deployment wheel associated with said deployment rod which is rotated to displace said deployment rod, wherein said rod and wheel are supported by said second support ribs and wherein said cutting blade is extended and held relative to said blade opening at any desired distance from fully extended to fully retracted.

17. The utility knife system of claim 16 wherein said deployment rod includes threads to mesh with threads at the center of the deployment wheel, wherein said deployment wheel is held in place by said second ribs so that the deployment rod translates when said deployment wheel rotates; and wherein said knife system handle includes a blade position slot for indicating to what extent said cutting blade is deployed using a position arm affixed to said blade retainer and a locking collar to lock the deployment wheel from further rotation.

18. The utility knife system of claim 16 wherein said deployment wheel includes a gear wheel and said deployment rod includes gear teeth, wherein said gear wheel meshes with said gear teeth to translate said deployment rod when said deployment wheel is rotated.

19. The utility knife system of claim 16 including a rear rod support affixed to said knife system handle within said internal cavity for rotationally supporting said deployment rod and a threaded front rod support affixed to said blade retainer so that rotation of said deployment rod translates the blade retainer with respect to said deployment rod.

* * * * *